US009181801B2

(12) United States Patent
Faulkner

(10) Patent No.: US 9,181,801 B2
(45) Date of Patent: Nov. 10, 2015

(54) PUMPABLE CRIB

(75) Inventor: Dakota Faulkner, New Kensington, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 278 days.

(21) Appl. No.: 13/453,546

(22) Filed: Apr. 23, 2012

(65) Prior Publication Data

US 2012/0269585 A1 Oct. 25, 2012

Related U.S. Application Data

(63) Continuation of application No. 61/477,929, filed on Apr. 21, 2011.

(51) Int. Cl.
*E21D 15/00* (2006.01)
*E21D 15/48* (2006.01)

(52) U.S. Cl.
CPC ..... *E21D 15/483* (2013.01)

(58) Field of Classification Search
CPC ..... E02D 35/00; E21D 11/00
USPC ..... 405/288, 289, 273, 229, 230
See application file for complete search history.

(56) References Cited

U.S. PATENT DOCUMENTS

| | | | | |
|---|---|---|---|---|
| 3,188,041 | A | 6/1965 | Town | |
| 3,358,906 | A * | 12/1967 | Faiers | 383/86 |
| 3,984,989 | A | 10/1976 | Turzillo | |
| 4,255,071 | A | 3/1981 | Koppers et al. | |
| 4,277,204 | A | 7/1981 | Koppers et al. | |
| 4,332,512 | A | 6/1982 | Heintzmann et al. | |
| 4,983,077 | A | 1/1991 | Sorge et al. | |
| 5,015,125 | A | 5/1991 | Seegmiller | |
| 5,273,378 | A | 12/1993 | Merz et al. | |
| 5,308,196 | A | 5/1994 | Frederick | |
| 6,394,707 | B1 | 5/2002 | Kennedy et al. | |
| 7,654,777 | B2 | 2/2010 | Skarbovig | |
| 2003/0039412 | A1 * | 2/2003 | Rodick | 383/211 |
| 2010/0104376 | A1 | 4/2010 | Skarbovig | |
| 2010/0183371 | A1 * | 7/2010 | Witz | 405/171 |
| 2010/0247249 | A1 | 9/2010 | Skarbovig | |
| 2011/0222970 | A1 | 9/2011 | Skarbovig | |
| 2011/0262231 | A1 | 10/2011 | Hussey et al. | |
| 2012/0009023 | A1 | 1/2012 | Bower et al. | |

FOREIGN PATENT DOCUMENTS

WO WO 2009/053797 * 4/2009

* cited by examiner

*Primary Examiner* — Sean Andrish

(57) ABSTRACT

A pumpable crib bag assembly includes a containment bag having a body and a supporting member. The containment bag is configured to contain a cementitious material therein and has a first end, a second end, and an outer surface. The pumpable crib bag assembly further includes a reinforcing layer positioned adjacent to the outer surface of the containment bag.

11 Claims, 3 Drawing Sheets

PUMPABLE CRIB

CROSS REFERENCE TO RELATED APPLICATION

This application claims the benefit of U.S. Provisional Application No. 61/477,929, filed Apr. 21, 2011, the entire content of which is hereby incorporated by reference.

BACKGROUND OF THE INVENTION

1. Field of the Invention

This invention is related to a method and apparatus for supporting a mine opening and, more particularly, to a pumpable crib and a method for installing a pumpable crib used to support a mine opening.

2. Description of Related Art

Cribbing is frequently used to provide support in underground mine openings. Wooden cribbing formed from stacked pieces of timber generally allows for large amounts of vertical displacement prior to failure. Pumpable cribs, which are formed by pumping a cementitious material into a collapsible containment bag, generally withstand much larger loads than wooden cribbing, but do not allow for as much vertical displacement as the wooden cribbing prior to failure. The containment bags are typically textile or fabric bags made of polypropylene and/or polyethylene, which are secured to a roof of the mine opening. The containment bags usually have a tube and one-way valve for receiving the cementitious material under pressure.

SUMMARY OF THE INVENTION

In one embodiment, a pumpable crib bag assembly includes a containment bag having a body and a supporting member. The containment bag is configured to contain a cementitious material therein and has a first end, a second end, and an outer surface. The pumpable crib bag assembly further includes a reinforcing layer positioned adjacent to the outer surface of the containment bag.

The body of the containment bag may include a plurality of layers, with a supporting member positioned between the plurality of layers. The reinforcing layer may circumferentially surround the containment bag and may extend from the first end to the second end of the containment bag. The reinforcing layer may comprise polyethylene. The reinforcing layer may comprise about 60-150 gauge polyethylene sheet material. The reinforcing layer may be a single sheet of material circumferentially surrounding the containment bag and extending from the first end of the containment bag to the second end of the containment bag. The containment bag may be substantially cylindrical or substantially frusto-conical.

In a further embodiment, a method of installing a pumpable crib includes securing a first end of a containment bag to a roof portion of a mine opening, positioning a second end of the containment bag on a floor portion of the mine opening, filling the containment bag with a cementitious material, and positioning a reinforcing layer around an outer surface of the containment bag.

The reinforcing layer may be helically wrapped around the containment bag and extend from the first end to the second end of the containment bag. The reinforcing layer may be a single sheet extending circumferentially around the containment bag and extending from the first end to the second end of the containment bag. The containment bag may include a body and a supporting member. The reinforcing layer may comprise polyethylene. The reinforcing layer may comprise about 60-150 gauge polyethylene sheet material. The containment bag may be filled with the cementitious material via a fill tube positioned adjacent the first end of the containment bag. Further, the supporting member may be a helically wound wire and the body of the containment bag may include a plurality of layers, with the supporting member positioned between the plurality of layers.

DESCRIPTION OF THE PREFERRED EMBODIMENTS

Figure 1:
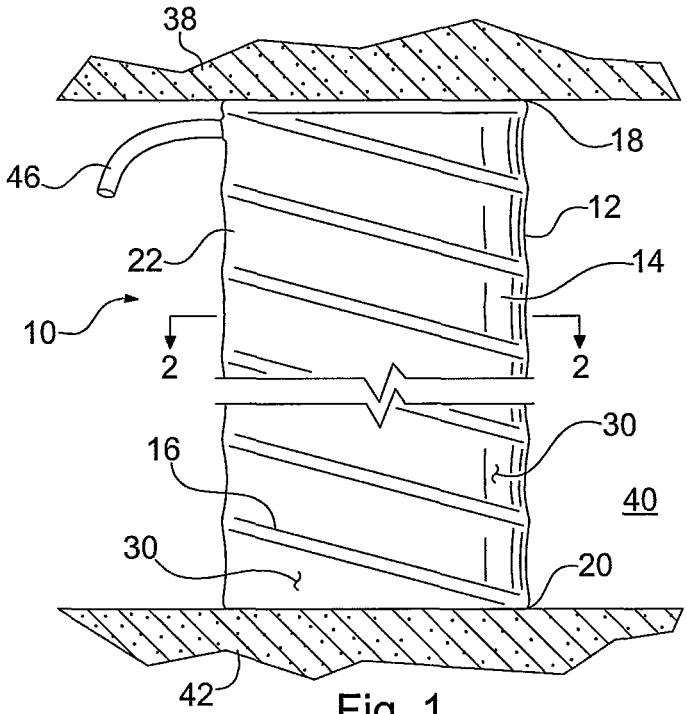
FIG. 1 is an elevational view of a pumpable crib according to one embodiment of the present invention.

The present invention will now be described with reference to the accompanying figures. For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Figure 2:
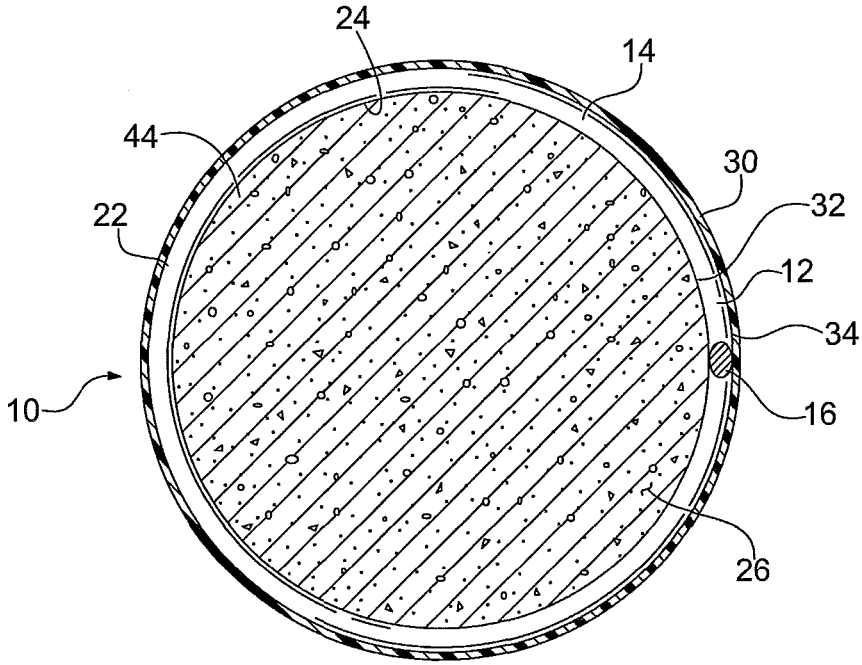
FIG. 2 is a cross-sectional view taken along the line 2-2 shown in FIG. 1.

Referring to FIGS. 1 and 2, one embodiment of a pumpable crib bag assembly 10 includes a containment bag 12 having a body 14 and a supporting member 16. The containment bag 12 has a first end 18, a second end 20, an outer surface 22, and an inner surface 24. The containment bag 12 defines an interior space 26 configured to receive and contain a cementitious material. A reinforcing layer 30 is positioned adjacent to the outer surface 22 of the containment bag 12. The body 14 of the containment bag 12 is cylindrical and includes a plurality of layers 32, 34 of material. In particular, the body 14 of the containment bag 12 may include an inner layer 32 of material that is non-permeable to water and an outer layer 34, although the body 14 may be formed from a single, integral piece of material. The supporting member 16 is a steel wire that helically extends around the circumference of the containment bag 12. The supporting member 16 is positioned between the inner and outer layers 32, 34 of the body 14 of the containment bag 12, although the supporting member 16 may also be secured to the inner surface 24 or outer surface 22 of the containment bag 12. In a particular non-limiting embodiment, the containment bag 12 may be a conventional containment bag manufactured by Schaumburg having an 18 oz. fabric and a single 3/16" wire that spirals down from the first end 18 to the second end 20 with a 4" pitch. The containment bag 12 may have a diameter of 24", 27", 30", and 36", although other suitable diameters may be utilized.

Referring to FIG. 2, the reinforcing layer 30 circumferentially extends around the containment bag 12 and extends from the first end 18 to the second end 20 of the containment bag 12, although the reinforcing layer 30 may cover only a portion of the circumference of the containment bag 12 and only extend for a portion of the length of the containment bag 12. The thickness of the reinforcing layer 30 and the containment bag 12 has been exaggerated in FIG. 2 for clarity. The reinforcing layer 30 may be a shrink-wrap material commonly used to wrap pallets of material for shipping. In particular, the reinforcing layer 30 may be formed from about 60-150 gauge polyethylene sheet material, although other suitable materials and thicknesses may be utilized. The reinforcing layer 30 may be separate from the containment bag 12 or formed integrally with the containment bag 12. As discussed below, the reinforcing layer 30 is flexible and may be formed from a material having greater flexibility or ductility compared to the containment bag 12.

Referring again to FIGS. 1 and 2, in use, the first end 18 of the containment bag 12 is engaged with a roof portion 38 of a mine opening 40, and the second end 20 of the containment bag 12 is engaged with a floor portion 42 of the mine opening 40. A cementitious material 44 is received and contained within the interior space 26 of the containment bag 12. The containment bag 12 includes a fill tube 46 for supplying the cementitious material 44 to the interior space 26 of the containment bag 12. The containment bag 12 may also include a vent tube (not shown) to vent the air contained within the interior space 26 while the containment bag 12 is filled with the cementitious material 44.

The pumpable crib bag assembly 10 shown in FIGS. 1 and 2 may be installed by securing the first end 18 of the containment bag 12 to the roof 38 of the mine opening 40 using a fastener (not shown) that extends through an eyelet (not shown) in the bag 12. For example, the containment bag 12 may be secured directly to the roof 38 using an explosive anchor or may be secured to a mesh structure (not shown) positioned on the roof 38 using a zip tie. The second end 20 of the containment bag 12 is extended so that the second end 20 is positioned on the floor 42 of the mine opening 40. The fill tube 46 is connected to fill lines (not shown) and the cementitious material 44 is pumped under pressure into the containment bag 12 until the entire bag is full. The reinforcing layer 30 is then positioned around the outer surface 22 of the containment bag 12. The reinforcing layer 30 may be helically wrapped around the circumference of the containment bag 12 using a continuous sheet of material formed on a roll. The reinforcing layer 30 engages the containment bag 12 and also engages other portions of the reinforcing layer 30 as it is wrapped around the containment bag 12. The reinforcing layer 30, however, may also be formed integrally with the containment bag 12 and positioned adjacent to the outer surface 22 of the containment bag 12 prior to installation of the containment bag 12.

Under loading and vertical displacement of the pumpable crib bag assembly 10, the reinforcing layer 30 prevents fractured cementitious material 44 from falling out of the containment bag 12, which frequently ruptures during vertical displacement of the assembly 10. The reinforcing layer 30 is flexible and stretches to contain the fractured cementitious material 44 as it leaves the containment bag 12. The pumpable crib bag assembly 10 has improved residual loading characteristics compared to a conventional pumpable crib.

Figure 3:
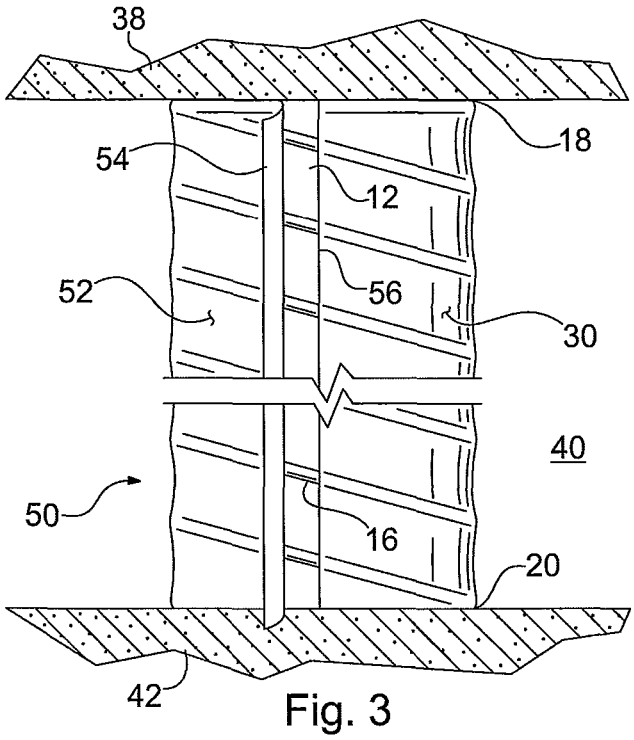
FIG. 3 is an elevational view of the pumpable crib shown in FIG. 1.

Referring to FIG. 3, a second embodiment of a pumpable crib bag assembly 50 is disclosed. The pumpable crib bag assembly 50 is similar to the pumpable crib bag assembly 10 shown in FIGS. 1 and 2 except that the reinforcing layer 30 is provided as a single sheet 52 having a first end 54 and a second end 56 that is wrapped around the containment bag 12. The first end 54 of the sheet 52 is secured to the second end 56 of the sheet 52. The first end 54 of the sheet 52 may be secured to the second end 56 using a plurality of zip ties (not shown). The first end 54 of the sheet 52 may also be secured to the second end 56 using a zipper (not shown), although other suitable closure elements and fasteners may be utilized. Although not shown, the reinforcing layer 30 may also be provided as a cylindrically-shaped bag that circumferentially surrounds the containment bag 12 and is secured to the containment bag 12 via one or more fasteners, such zip ties.

Figure 4:
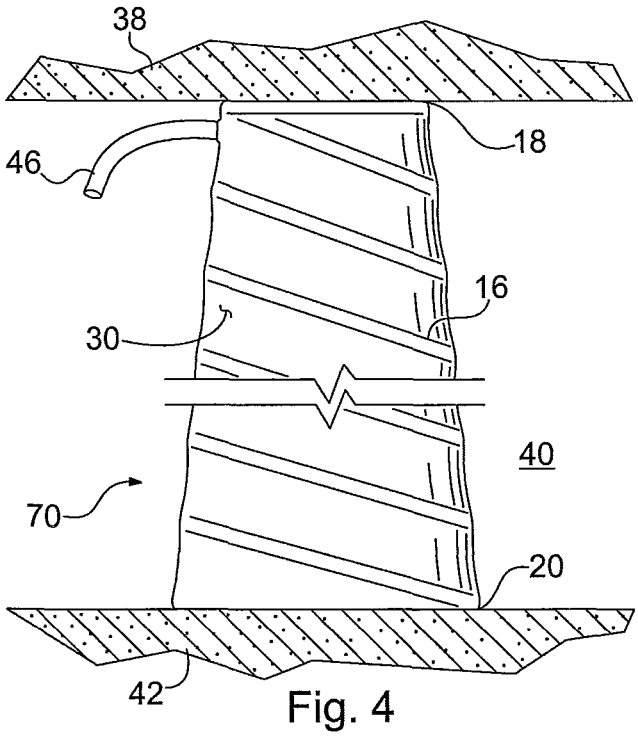
FIG. 4 is an elevational view of a pumpable crib according to a second embodiment of the present invention.

Referring to FIG. 4, a third embodiment of a pumpable crib bag assembly 70 is shown. The pumpable crib bag assembly 70 is similar to the pumpable crib bag assembly 10 shown in FIGS. 1-3, but has a frusto-conical shape, with the diameter of the first end 18 being smaller than the diameter of the second end 20. The frusto-conical shape enhances stability by providing a lower center of gravity and also provides increased critical load capacity. In addition, the frusto-conical shape mitigates floor heave due to its larger bottom area compared to a cylindrical-shaped crib.

Figure 5:
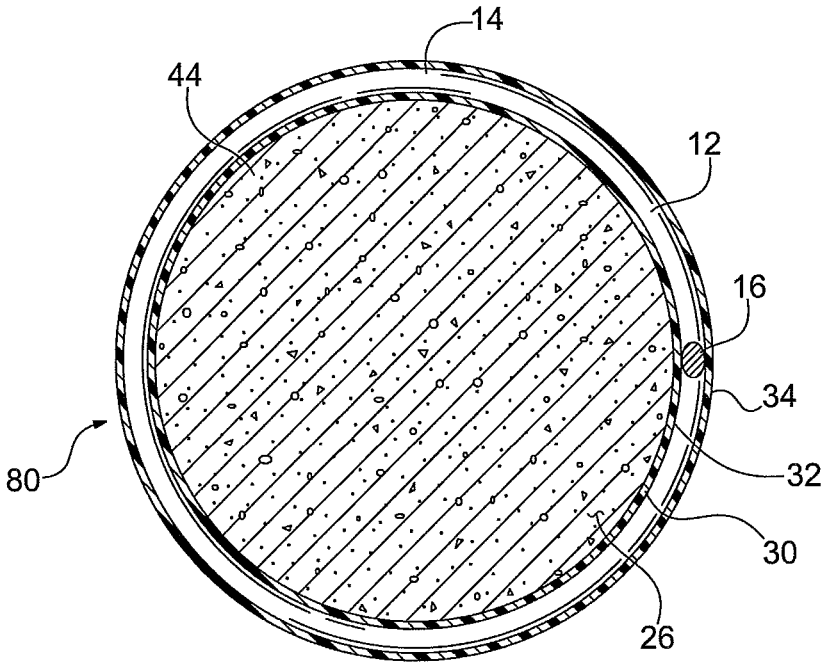
FIG. 5 is a cross-sectional view of a pumpable crib according to a third embodiment of the present invention.

Referring to FIG. 5, a fourth embodiment of a pumpable crib bag assembly 80 is shown. The pumpable crib bag assembly 80 is similar to the pumpable crib bag assembly 10 shown in FIGS. 1-3 except that the reinforcing layer 30 is positioned on the inner surface 24 of the containment bag 12. Thus, in use, the reinforcing layer 30 will be positioned between the cementitious material 44 and the inner surface 24 of the containment bag 12. The reinforcing layer 30 may be cylindrical and received within the cylindrical body 14 of the containment bag 12. The reinforcing layer 30 may also have a smaller outer diameter than the inner diameter of the containment bag 12 such that cementitious material 44 is positioned between the containment bag 12 and the reinforcing layer 30. As discussed above, the reinforcing layer 30 may be formed from a polyethylene, shrink-wrap material and may also be formed as a cylindrical sleeve. The reinforcing layer 30 also may be formed from a mesh material that allows the cementitious material 44 to flow through the reinforcing layer 30. In one particular embodiment, the reinforcing layer 30 consists entirely of a cylindrical mesh sleeve without any additional supporting structure for the reinforcing layer 30.

While several embodiments were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A pumpable crib bag assembly comprising:

a containment bag having a body and a supporting member, the containment bag configured to contain a cementitious material therein and having a first end, a second end, and an outer surface, wherein the body of the containment bag comprises a cylindrical inner layer that defines an interior space for containing the cementitious material therein and a cylindrical outer layer concentrically disposed about the cylindrical inner layer, wherein the cylindrical inner layer and the cylindrical outer layer define an open space therebetween, the supporting member positioned in the open space and in contact with each of the cylindrical inner layer and the cylindrical outer layer, wherein the cylindrical inner layer is non-permeable to prevent the cementitious material from passing from the interior space therethrough to the open space, wherein the supporting member comprises a helically wound wire; and a reinforcing layer positioned adjacent to the outer surface of the containment bag, wherein the reinforcing layer comprises a single sheet of material circumferentially surrounding the containment bag and extending from the first end of the containment bag to the second end of the containment bag.

2. The assembly of claim 1, wherein the reinforcing layer comprises polyethylene.

3. The assembly of claim 1, wherein the reinforcing layer comprises about 60-150 gauge polyethylene sheet material.

4. The assembly of claim 1, wherein the containment bag is substantially cylindrical.

5. The assembly of claim 1, wherein the containment bag is substantially frusto-conical.

6. A method of installing a pumpable crib comprising:

providing a containment bag having a body and a supporting member, wherein the body of the containment bag comprises a cylindrical inner layer that defines an interior space for containing the cementitious material therein and a cylindrical outer layer concentrically disposed about the cylindrical inner layer, wherein the cylindrical inner layer and the cylindrical outer layer define an open space therebetween, the supporting member positioned in the open space and in contact with each of the cylindrical inner layer and the cylindrical outer layer, wherein the cylindrical inner layer is non-permeable to prevent the cementitious material from passing from the interior space therethrough to the open space, wherein the supporting member comprises a helically wound wire;

securing a first end of the containment bag to a roof portion of a mine opening;

positioning a second end of the containment bag on a floor portion of the mine opening;

filling the containment bag with a cementitious material; and positioning a reinforcing layer around an outer surface of the containment bag.

7. The method of claim 6, wherein the reinforcing layer is helically wrapped around the containment bag and extends from the first end to the second end of the containment bag.

8. The method of claim 6, wherein the reinforcing layer is a single sheet extending circumferentially around the containment bag and extending from the first end to the second end of the containment bag.

9. The method of claim 6, wherein the reinforcing layer comprises polyethylene.

10. The method of claim 7, wherein the reinforcing layer comprises about 60-150 gauge polyethylene sheet material.

11. The method of claim 6, wherein the containment bag is filled with the cementitious material via a fill tube positioned adjacent the first end of the containment bag.

* * * * *